US006777865B2

(12) United States Patent
Rossi

(10) Patent No.: US 6,777,865 B2
(45) Date of Patent: Aug. 17, 2004

(54) TWO-PIECE SECOND ANODE BUTTON FOR CATHODE RAY TUBE

(75) Inventor: Juan J. Rossi, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 81 days.

(21) Appl. No.: 10/213,672

(22) Filed: Aug. 6, 2002

(65) Prior Publication Data

US 2004/0061427 A1 Apr. 1, 2004

(51) Int. Cl.[7] ..... H01J 29/50

(52) U.S. Cl. ..... 313/477 HC; 313/477 R; 313/482

(58) Field of Search ..... 313/477 R, 479, 313/480, 482, 477 HC

(56) References Cited

U.S. PATENT DOCUMENTS 3,666,343 A * 5/1972 McNeill ..... 445/36
4,155,614 A * 5/1979 Hall ..... 439/278
4,198,588 A * 4/1980 Kuze et al. ..... 313/479
4,950,947 A * 8/1990 Nakamura ..... 313/477 HC
6,236,155 B1 * 5/2001 Rossi ..... 313/477 R

* cited by examiner

*Primary Examiner*—Vip Patel
*Assistant Examiner*—Kevin Quarterman
(74) *Attorney, Agent, or Firm*—Kenneth D. Labudda

(57) ABSTRACT

A two-piece second anode button for a cathode ray tube has: a first portion defined by a cup-shaped can having a seating area at its widest part and a second portion comprising and a planar annulus fixed in said seating area, said first portion comprising a nickel-iron alloy having a composition of about 47 wt. % nickel, about 6 wt. % chromium and the balance iron and said second portion comprising a ferritic stainless steel alloy having a chromium content of about 10 to about 28% by weight.

6 Claims, 3 Drawing Sheets

TWO-PIECE SECOND ANODE BUTTON FOR CATHODE RAY TUBE

TECHNICAL FIELD

This invention relates to glass-to-metal sealing and particularly to metallic second anode buttons sealed into the glass funnels of cathode ray tubes. Still more particularly it relates to second anode buttons having good sealing capability but reduced cost.

BACKGROUND ART

Cathode ray tubes require numerous electrical potentials to be applied to the electrodes of the tube. One of these, the second anode, has a very high potential, in the order of 30 kV or more in the case of color picture tubes applied thereto. This potential is conventionally applied through the funnel by a connector hermetically sealed therein. This connector is conventionally called a second anode button. It is a substantially hollow, electrically conductive button having a thermal coefficient of expansion that substantially matches that of the glass into which it is sealed. Prior to insertion the button is oxidized so that an oxide-to-oxide bond is formed with the glass.

The two piece buttons comprise a can portion with an annulus fixed therein and have been made from two pieces of a 42% Ni-6% Cr iron alloy (ASTM F31) and more recently from a 47% Ni-6% Cr iron alloy (known commercially as N485). Other iron-based alloys that have been used for glass-to-metal seals include chromium-free nickel alloys (ASTM F30) and 18 to 26% chromium-iron alloys; however, neither of the latter two is known to have been used for anode buttons.

The thermal expansion-contraction differences between glass and metal generate the mismatch stresses that account for much of the breakage of cathode ray tubes that takes place during heat cycles at fabrication. Examination of volume-temperature diagrams for the typical lead or soda-lime glasses used for the funnels show that they exhibit a non-linear behavior that can be matched to the volume-temperature curves of nickel-iron alloys in the 40 to 50% nickel range. However, due to their nickel content, these alloys are significantly more expensive than nickel-free alloys.

DISCLOSURE OF INVENTION

It is, therefore, an object of the invention to obviate the disadvantages of the prior art.

It is another object of the invention to enhance the glass-to-metal sealing of second anode buttons.

It is another object of the invention to reduce the cost of second anode buttons.

These objects are accomplished, in one aspect of the invention, by the provision of a two-piece second anode button for a cathode ray tube that comprises a first portion defined by a cup-shaped can having a seating area and a second portion comprising a planar annulus fixed in the seating area. The first portion comprises a nickel-iron alloy having a composition of 47 wt. % nickel, 6 wt. % chromium and the balance iron and the second portion comprises a ferritic stainless steel alloy having a chromium content of about 10 to about 28% by weight.

This button utilizes the preferred material for consummating the glass-to-metal seal and utilizes the less costly material for the annulus, which is entirely contained within the can. The annulus closely matches the thermal coefficient of expansion of the can and the funnel glass and is less costly than using the same material as the can. The can oxidizes well to form tight, hermetic seals with the funnel glass, thereby enhancing the cathode ray tubes with which it is employed.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 3:
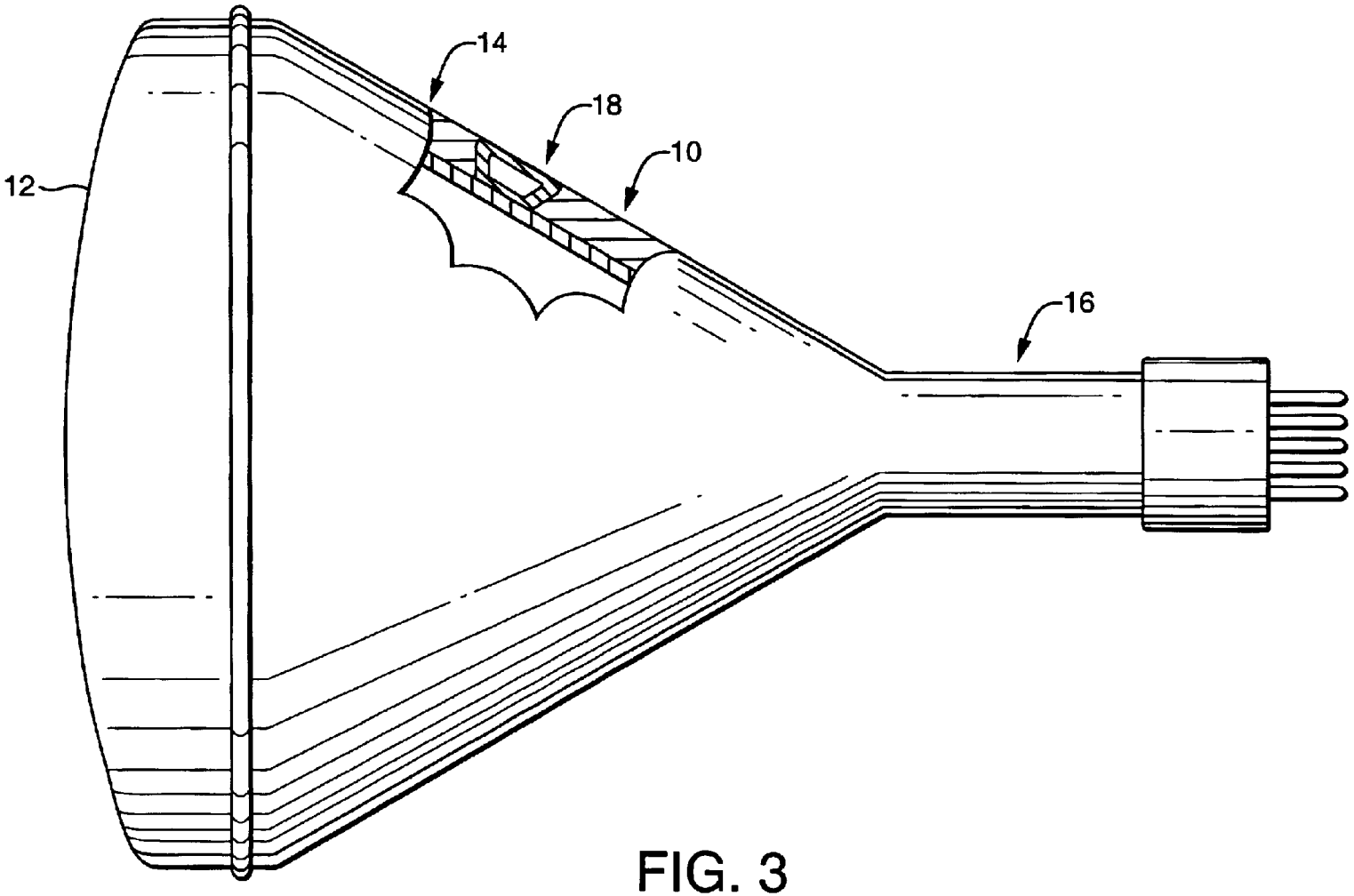
FIG. 3 is an elevational view, partially in section, showing diagrammatically an anode button in place in the funnel wall of a cathode ray tube.

Referring now to the drawings with greater particularity, there is shown in FIG. 3 a cathode ray tube 10 of a type that can be employed in color television receivers or as a computer monitor. The tube 10 has a face 12 upon which the display is presented and a funnel body 14 that is connected thereto and terminates in a neck 16. A second anode button 18 is hermetically sealed into the funnel 14. In accordance with an aspect of the invention, the button 18 is of a two-piece construction wherein the can 20 is formed of a conventional nickel-chromium alloy having a nominal composition of 47 wt. % nickel and 6 wt. % chromium with the balance being iron. The annulus 26, however, is fabricated from a less expensive material comprising a high chromium content stainless steel, for example, a nickel-free stainless steel containing from about 10 to about 28% by weight chromium.

Both of these alloys have thermal coefficients of expansion in the range of 11 to 12.5 ppm/° C. over the range of 30 to 530° C., and are a good match for the funnel glasses being used today.

These buttons are extremely workable and lend themselves to two-piece construction, with or without additional X-ray protection. Such buttons are shown, for example, in U.S. Pat. No. 3,666,343.

Figure 1:
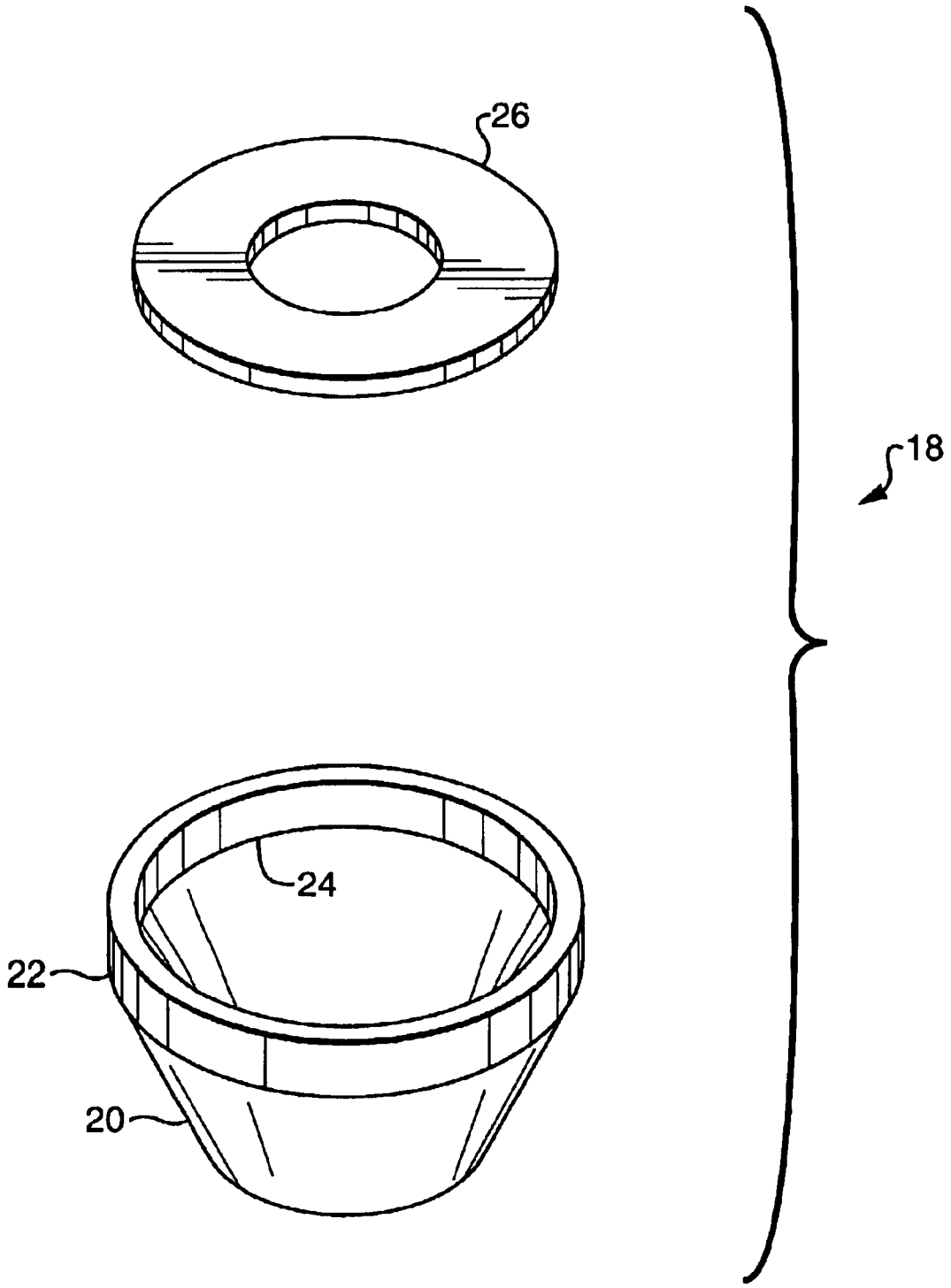
FIG. 1 is an exploded perspective view of a second anode button in accordance with an aspect of the invention.
Figure 2:
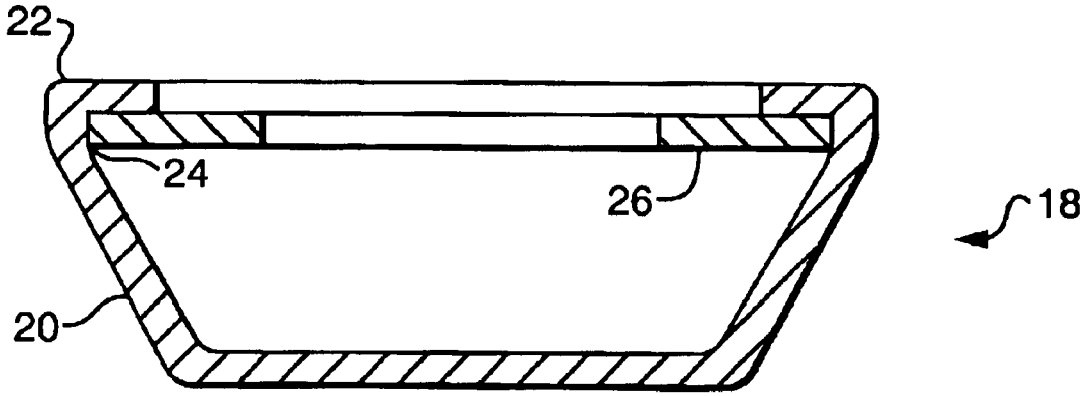
FIG. 2 is a sectional view of the anode button of the invention.

In a preferred embodiment, the button 18 comprises a frusto-conical can 20 that can be made by die drawing and, as initially formed includes an upstanding wall 22. The jointure of the wall 22 with the can body 20 forms a seating area 24. As noted the can is formed from a preferred nickel/chromium alloy. The second portion of the button is the annulus 26, which is formed from a nickel-free alloy. After the annulus is seated in the seating area the wall 22 is deformed to lie upon the annulus, thus fixing the annulus in position, as shown in FIG. 2.

This two-piece construction utilizing two different but compatible materials reduces the cost of the button without affecting the industry-preferred glass-to-metal sealing conditions.

Thus there are here provided second anode buttons that are economical to employ and that seal well to funnel glass.

While there have been shown and described what are at present considered the preferred embodiments of the invention, it will be apparent to those skilled in the art that various changes and modifications can be made herein without departing from the scope of the invention as defined by the appended claims.

What is claimed is:

1. A two-piece second anode button for a cathode ray tube comprising: a first portion defined by a cup-shaped can having a seating area and a second portion comprising and a planar annulus fixed in said seating area, said first portion comprising a nickel-iron alloy having a composition of about 47 wt. % nickel, about 6 wt. % chronium and the balance iron and said second portion comprising a ferritic stainless steel alloy having a chromium content of about 10 to about 28% by weight.

2. The second anode button of claim 1 wherein said annulus is nickel-free.

3. The second anode button of claim 1 wherein said cup-shaped can is frusto-conical and said seating area is formed at the widest part of said can.

4. A glass funnel for a cathode ray tube having hermetically sealed therein a two-piece second anode button, comprising a first portion defined by a can having a seating area and a second portion comprising a planar annulus fixed in said seating area, said first portion comprising a nickel-iron alloy having a composition of about 47 wt. % nickel, about 6 wt. % chromium and the balance iron and said second portion comprising a ferritic stainless steel alloy having a chronium content of about 10 to about 28% by weight.

5. The funnel of claim 4 wherein said hermetic seal is achieved by an oxide-to-oxide bond between said glass and said first portion of said button.

6. The glass funnel of claim 4, wherein said cup-shaped can is frusto-conical and said seating area is formed at the widest part of said can.

* * * * *